US006135377A

United States Patent [19]

Covelli et al.

[11] Patent Number: 6,135,377

[45] Date of Patent: Oct. 24, 2000

[54] YARN BRAKE FOR LOOMS

[75] Inventors: Marco Covelli, Occhieppo Inferiore; Giorgio Gabogna, Pralungo, both of Italy

[73] Assignee: Nouva Roj Electrotex S.r.l., Biella, Italy

[21] Appl. No.: 09/214,120

[22] PCT Filed: Jun. 26, 1997

[86] PCT No.: PCT/EP97/03357

§ 371 Date: Feb. 1, 1999

§ 102(e) Date: Feb. 1, 1999

[87] PCT Pub. No.: WO97/49630

PCT Pub. Date: Dec. 31, 1997

[30] Foreign Application Priority Data

Jun. 27, 1996 [IT] Italy ..... MI96A1310

[51] Int. Cl.[7] ..... B65H 59/12

[52] U.S. Cl. ..... 242/154

[58] Field of Search ..... 242/154, 417.2, 242/417, 147 M; 226/118.2

[56] References Cited

U.S. PATENT DOCUMENTS

| | | | |
|---|---|---|---|
| 1,605,842 | 11/1926 | Jones | 242/417.2 |
| 2,202,323 | 5/1940 | Sullivan | 242/154 |
| 2,571,678 | 10/1951 | Burns | 242/154 |
| 2,618,445 | 11/1952 | Buder | 242/154 |
| 2,899,221 | 8/1959 | Pieper | 242/154 |
| 2,932,151 | 4/1960 | Heffelfinger et al. | 242/154 |
| 2,949,253 | 8/1960 | Stoddard et al. | 242/154 |
| 3,258,214 | 6/1966 | Comstock | 242/417.2 |
| 3,559,916 | 2/1971 | Hilscher | 242/154 |
| 5,163,594 | 11/1992 | Meyer | 242/154 X |
| 5,226,459 | 7/1993 | De Ro et al. | 242/154 X |
| 5,368,244 | 11/1994 | Melillo et al. | 242/154 X |
| 5,791,541 | 8/1998 | Jitsuishi et al. | 226/118.2 X |

FOREIGN PATENT DOCUMENTS

| | | |
|---|---|---|
| 0 326 784 | 8/1989 | European Pat. Off. . |
| 0 527 510 | 8/1991 | European Pat. Off. . |
| 0 533 597 | 3/1993 | European Pat. Off. . |
| 1108770 | 1/1956 | France . |
| 41 31 656 | 3/1993 | Germany . |
| 345772 | 1/1937 | Italy . |

*Primary Examiner*—Donald P. Walsh
*Assistant Examiner*—Collin A. Webb
*Attorney, Agent, or Firm*—Young & Thompson

[57] ABSTRACT

A yarn brake includes a fixed frame, fixed and spaced-apart yarn guide elements defining together a straight yarn path through the yarn brake, a rotation drive, and at least one braking element projecting from the rotation drive beyond the straight yarn path. The braking element is controlled by the rotation drive to move through an angular stroke about a rotation axis that is spaced from and essentially parallel to the straight yarn path. The angular stroke has a starting position on one side of the path and a braking position on the other side of the path. An adjustment device varies the degree of deviation of the yarn by varying the braking position of the braking element. The distance between the rotation axis of the braking element and the straight yarn path is variable.

17 Claims, 3 Drawing Sheets

YARN BRAKE FOR LOOMS

BACKGROUND OF THE INVENTION

The present invention relates to a yarn brake for use in weaving machines.

A yarn brake—as known from EP-A-326784 by Loepfe—comprises, in addition to the two fixed yarn guide elements, a swiveling bridge supporting two further yarn guide elements, aligned with the straight yarn path in the starting position of four rod-shaped braking elements. A certain distance is set between the rotation axis of the braking elements and the straight yarn path. The bridge rotates about a further rotation axis, essentially parallel to and spaced from the straight yarn path. The bridge is resiliently biased against the braking elements, in its swiveling direction, by repelling magnets positioned into the frame. As the brake is operated, the braking elements are caused to perform an angular movement about their rotation axis from the starting position, laterally across the straight yarn path, into the braking position on the other side of said path. Due to the tension produced in the yarn, deviated by the braking elements and by the fixed yarn guide elements, the bridge yields with a certain stroke against the force of the repelling magnets. The adjustment device allows to vary the position of the repelling magnets inside the frame, so as to vary the counter-force of the bridge and to thereby vary the degree of yarn deviation and the braking force acting on the moving yarn.

Another yarn brake—as known from EP-A-527510 by Picanol—provides for the rotation axis of the two rod-shaped braking elements to be positioned perpendicularly to the straight yarn path and to intersect said path. Both braking elements are positioned on a rotatable disk controlled by a rotation drive. The angular stroke of the braking elements about the rotation axis is limited by taps supported by the frame. The angular position of the taps is adjustable about the rotation axis of the braking elements through a set of screws engaging into a ring supporting the taps inside the frame. Adjusting the angular position of the taps requires a change in the angular stroke of the rotatable disk and of the rotation drive.

A similar yarn brake—known from U.S. Pat. No. 3,406,832 by Rempei—is provided with two spaced apart stop devices of the frame, which interfere with the oscillating path of a lever projecting sideways from the rotatable body carrying the braking elements. Two cables, fixed to opposite sides of the lever, are connected with drawing magnets operating the rotatable body in both rotating directions. The stop devices of the frame are thus apt to reduce the maximum angular stroke of the rotatable body. It is possible to vary the degree of yarn deviation in the braking position of the braking elements by adjusting the stroke of the drawing magnets.

SUMMARY OF THE INVENTION

The object of the present invention is to supply a yarn brake that easily, but efficiently, varies the degree of yarn deviation in the braking position of the braking element with a simple structural design of the yarn brake.

Any variation of the distance between the rotation axis of the braking element and the straight yarn path is apt to vary the degree of yarn deviation in the braking position of said braking element. This can be obtained, either by moving said rotation axis closer to the straight yarn path or even further from said path, or by moving the straight yarn path closer to or further from said rotation axis, or finally, by reciprocally shifting both the rotation axis and the straight yarn path. It is anyhow appropriate to merely shift the rotation axis in respect of the straight yarn path, as the yarn brake is usually mounted in a predetermined position (defined by fixed yarn guide elements of the frame) in respect of the straight yarn path, aligned with adjacent structural components forming part of yarn processing system, for example a weft yarn feeder and the weft yarn insertion means of a loom.

In a further embodiment, the adjustment device shift the rotation axis of the braking element in respect of the straight yarn path.

Another embodiment achieves a simple structure design, in that the amplitude of the angular stroke of the braking element, between its starting position and the braking positions, remains unvaried independently from the selected distance between the rotation axis and the straight yarn path. With a same angular stroke of the braking element it is possible to obtain different degrees of yarn deviation in the braking position of the braking elements, by varying the length of the active lever arm of the braking element, i.e. the distance between the rotation axis and the contact point with which the braking element engages the yarn to cause its deviation. A constant rotary motion allows to use a simple rotation drive. Furthermore, the operating stroke of the rotation drive can be made to exactly correspond to the angular stroke.

Yet another embodiment achieves an even simpler structural design by mounting the stop devices, which define the starting position and the braking position, in fixed positions. The stop devices are apt to limit the angular motion of the braking element or of the rotation drive.

In yet a further embodiment, the braking element directly bears against the stop devices, which allows stopping the yarn brake without producing any vibrations; the stopping action is efficiently supported by the resiliency of the material used for the stop devices.

Still a further embodiment is particularly important and involves great structural simplicity. To vary the degree of yarn deviation, the structural unit is mounted on the frame. Any adjustments can be easily carried out. Suitable positions of the unit can be reset in a precise manner. The angular stroke of the braking element, between its starting position and the braking position, may remain unvaried.

In yet a further embodiment the yarn deviation degree can be varied by varying the distance between the stop devices and the rotation axis of the braking element. On the other hand, the adjustment of the stop devices can for example be used to correct the yarn deviation degree in the event that only a few and roughly distributed positions to adjust the rotation axis should be provided.

A further embodiment realizes a simple and reliable structural design. The U-shaped bracket constitutes two simultaneously acting brake elements. Advantageously, the rotation drive or its shell are apt to support the stop devices. The unit is connected to the frame through the shell of the rotation drive or a support thereof. By mounting the unit into a cut-out section of the frame, one obtains a compactness in the overall dimensions of the yarn brake.

Another embodiment varies the length of the projecting part of the braking element, so as to obtain a minimum counter-torque of the mass of the braking element on the drive shaft.

The in another embodiment the shape of the braking element is advantageous in view to minimum moving masses. Furthermore, the slanting crossbar interconnecting the two arms of the U-shaped bracket prevents the yarn from getting caught around the braking element, which could otherwise occur, for instance with highly twisted yarns.

A simple structural design of the frame and an easy adjustment of the degree of yarn deviation is provided by a further embodiment.

Still another embodiment allows to preset different positions of the unit in the frame, representing different degrees of yarn deviation.

Yet another embodiment conveniently varies the degree of yarn deviation. The adjusting screw allows a fine gradual change of the position of the unit in the frame. The releasable fastening means are apt to firmly secure the unit to the frame in the instantly selected position of adjustment.

Another embodiment is advantageous for an efficient yarn braking, with many points of deviation. The third yarn guide element is aligned with the other two fixed yarn guide elements.

The, the yarn brake has a compact overall dimension with a structure of reduced weight in still a further embodiment. The yarn guide elements and the components for the support thereof do not interfere with the movement of the braking element.

In a further variation, the structural design has the advantage to prevent yarn stops.

BRIEF DESCRIPTION OF THE DRAWINGS

The invention will now be described in further detail, with reference to some preferred embodiments thereof illustrated by way of example on the accompanying drawings, in which.

DESCRIPTION OF THE PREFERRED EMBODIMENTS

As known, in yarn processing systems, yarn brakes are frequently adopted to either produce a tension in the yarn, or control yarn tension, or else slow down the movement of the yarn. An example of yarn processing system is represented by a loom, to which there are associated weft yarn feeding devices. The yarn, withdrawn from the feeding device by insertion means forming part of the loom, needs—under certain circumstances—to be braked according to the weaving cycle, i.e. during each insertion, in a controlled manner, with a varying braking effect. The so-called yarn deviation brakes have proved their effectiveness in ensuring such a controlled yarn braking. When deviating a yarn from its straight path, the braking action on the yarn is determined by the friction forces and by the angles of deviation at the points where the yarn is deviated in respect of the yarn guide elements, which points are created for the purpose by the braking element of the yarn brake. The angle of deviation influences the braking effect according to an exponential function. Consequently, the variations in the angle of deviation (or degree of deviation) are an effective measure to precisely vary the braking action in a wide range.

At certain times, during each weft insertion, any braking effect or friction influence on the yarn is detrimental and undesirable.

Due to such requirements and to the short time taken for each weft insertion in modern looms, i.e. less than a second, it becomes essential to adopt controlled yarn brakes which are extremely reliable and have a quick response. The prevailing influence on the braking effect of the angle of deviation is a useful parameter to vary the braking effect (for example, for different yarn qualities and different speed conditions).

The described embodiments of yarn brakes involve yarn deviation brakes wherein the degree of yarn deviation can be varied upon request. The braking element provided is moved into its braking position with a driving force higher than the counterforce of the yarn, and it is kept in the braking position for the whole time required to brake the yarn. In any case, said brakes can be controlled by varying the action force of the braking elements so that the yarn itself is, at least partially, apt to move back the braking element from its braking position in the direction towards its starting position.

Figure 1:
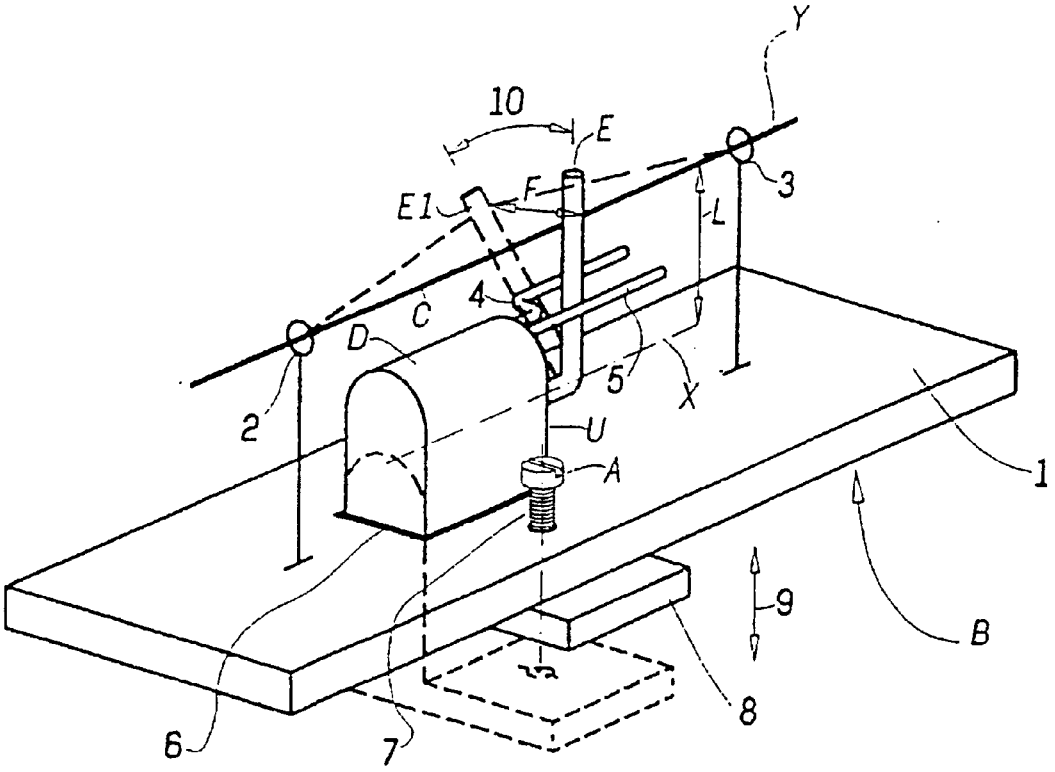
FIG. 1 is a diagrammatic perspective view of a yarn brake according to the invention.
Figure 2:
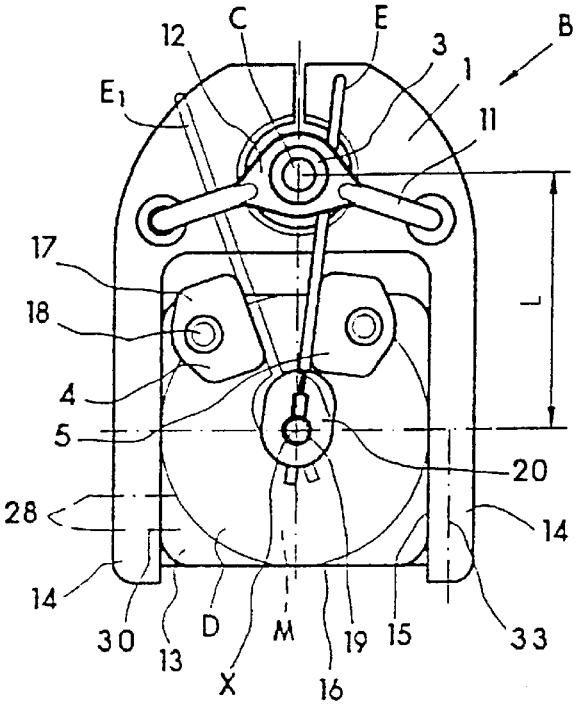
FIGS. 2 and 3 are diagrammatic front views of a concise embodiment of the yarn brake in two different working positions.
Figure 3:
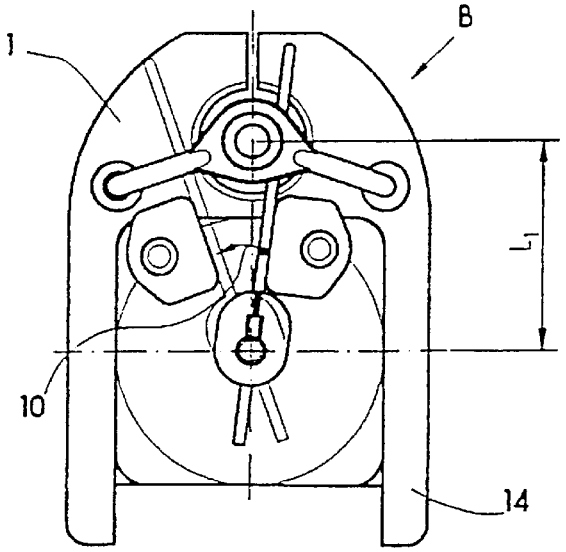
Figure 4:
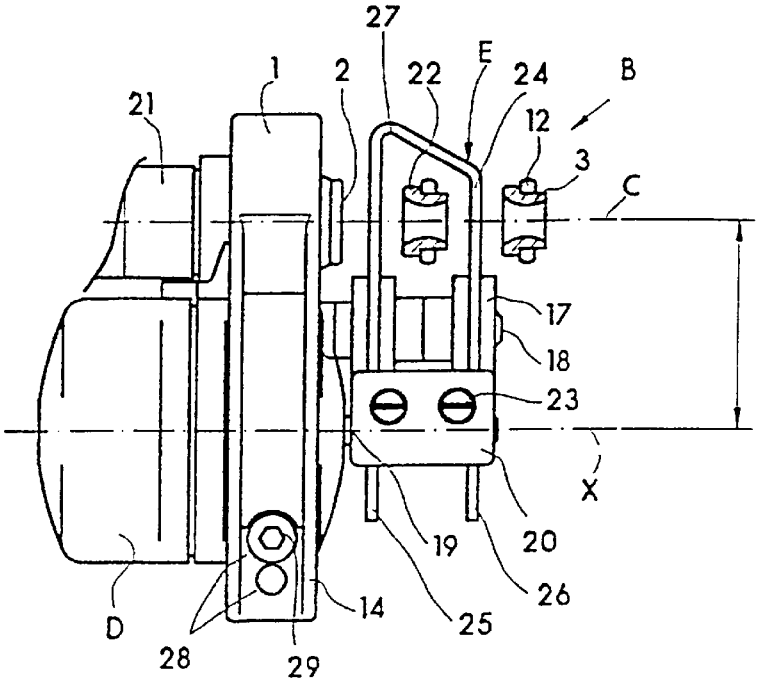
FIG. 4 is a side view of the yarn brake of FIGS. 2 and 3.

The yarn brake B, illustrated in FIG. 1, comprises a frame 1 (or generally a fixed support to mount the brake thereon) carrying fixed yarn guide elements 2 and 3 defining together a straight yarn path C along which a yarn Y extends, in free conditions, through the yarn brake B. The yarn guide elements 2 and 3 include annular yarn eyelets. On the frame 1 there is mounted a rotation drive D, the rotation axis X of which is essentially parallel to and spaced from the straight yarn path C. The rotation drive D causes at least one braking element E to perform an angular stroke between a starting position (continuous lines in FIG. 1) and at least one braking position E1 (dashed lines in FIG. 1). In the embodiment of FIG. 1, the braking element E is shaped as a rod and it extends from the axis X beyond the straight yarn path C. In the starting position, the braking element E is placed on one side of the straight yarn path C. To brake the yarn Y the braking element E moves, with an angular stroke 10, to the other side of the straight yarn path C, drawing the yarn therewith and causing its deviation in three points, i.e. in correspondence of the yarn guide eyelet 2, about the braking element in the braking position E1, and in correspondence of the other yarn guide eyelet 3. The degree of yarn deviation is indicated by F and determines the braking effect of the yarn brake B. The distance between the axis X and the straight yarn path C is indicated by L and can be varied by means of an adjustment device A incorporated in the structure of the yarn brake B. By varying the distance L (and with a given angular stroke 10 of the braking element E about the axis X), the degree F of yarn deviation is automatically varied, since the active lever arm of the yarn contacting point of the braking element E is accordingly varied.

The angular stroke 10 of the braking element E is limited by two separate stop devices 4 and 5, engaging the braking element E in its starting position and, respectively, in its braking position (E1). In the embodiment of FIG. 1, both stop devices 4 and 5 are mounted on the rotation drive D; however, such stop devices could alternatively be mounted directly on the frame 1.

In the embodiment illustrated in FIG. 1, the rotation drive D, the stop devices 4 and 5, and the braking element E, define a structural unit U which is movable inside the frame 1, in respect of the straight yarn path C, in the direction of the double arrow 9 so as to vary the distance L. For example, the rotation drive D is positioned in a cut-out section 6 of the frame 1 and can be shifted in the direction of the double arrow 9 by means of the adjustment device A. This can be obtained by any support means allowing to selectively position the unit U in different positions in respect of the frame 1 and of the straight yarn path C. In this embodiment, at least one adjusting screw 7—penetrating into the frame 1 and engaging into a flange 8 of the rotation drive D—allows to shift the unit U, either upwards or downwards, and to firmly secure it to the frame in each selected position. Since the stop devices 4 and 5 are shifted together with the rotation drive D in the unit U, the angular stroke 10 of the braking element E remains unvaried independently from the starting position of the unit U within the adjustment range.

Figure 5:
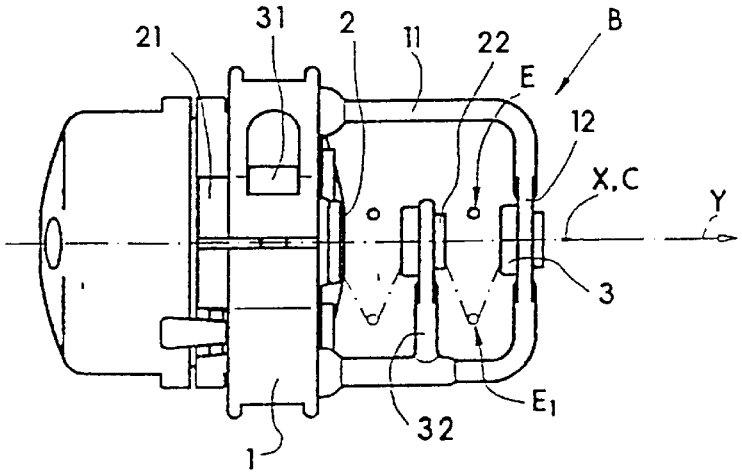
FIG. 5 is a top view of the yarn brake of FIGS. 2 to 4.

The concise embodiment illustrated in FIGS. 2 to 5 represents a compact yarn brake structure, comprising a generally U-shaped frame 1 to fix the yarn brake B onto a structural support component 21 which, for example, carries the upstream yarn guide element 2 of the yarn brake B. The frame 1 is firmly secured to the component 21 thanks to the clamping action of fastening screws 31 (FIG. 5). The frame 1 carries a U-shaped support 11 holding the downstream yarn guide element 3—an annular ceramic yarn eyelet—by way of a cover part 12 which fully surrounds the yarn eyelet 3 and has rounded or smoothed joints of connection to the support 11. A third yarn guide element 22 is provided between the yarn guide elements 2 and 3, in alignment therewith, said element 22 being supported by a column 32 projecting into the support 11.

The frame 1 comprises two essentially parallel sidewalls 14, apt to define a cut-out section 16 which houses the rotation drive D by way of its shell 13; the shell 13 has an at least partially rectangular contour which fits between the frame sidewalls 14, apt to define a sliding guide 15 for the rotation drive D. The stop devices 4 and 5—consisting of pairs of elastomeric or rubber blocks 17—are fixed to the shell 13 of the rotation drive D by means of supporting columns 18. The drive shaft 19 of the rotation drive D, coaxial to the rotation axis X of the braking element E, carries a clamping sleeve 20 having screws 23 to connect the braking element E with the rotation drive D.

In the embodiments of FIGS. 2 to 5, the braking element E consists of a generally U-shaped bracket 24, for instance of steel wire, having parallel arms 25 and 26 and an interconnecting crossbar 27. The arms 25 and 26 are of different length, the arm 25 being longer than the arm 26, so that the crossbar 27 extends obliquely with respect to the straight yarn path C. The projecting length of the braking element E from the clamping sleeve 20 can be adjusted, if required, by means of the screws 23.

At least one sidewall 14 of the frame 1 is provided with a plurality of holes 28 to house a fastening screw 29 engaging into the shell 13 of the rotation drive D. By unscrewing the screw 29 from the shell 13—from the counterbore 30 therein—and shifting upwards the rotation drive D from its lowest position (FIG. 2) to a higher position (FIG. 3) in the cut-out section 16, and by inserting the fastening screw 29 into another hole 28 of the sidewall 14, the distance L is reduced to L1 so as to obtain a lower degree of yarn deviation.

Alternatively, instead of providing the holes 28 in one of the sidewalls 14, such holes could be formed into the shell 13. It would equally be possible to provide for more than two different positions of adjustment. Likewise, a longitudinally extending slit could be provided, to allow continuously adjusting the position of the rotation drive D. As an alternative, or in addition, an adjusting screw 33 could be provided into at least one of the sidewalls 14 (FIG. 2), to simplify adjusting the position of the rotation drive D in respect of the frame 1 (stepless adjustment). Furthermore, the frame sidewalls 14 could be provided with longitudinally extending inner grooves, to guide corresponding flanges provided on the shell 13, so as to improve the guiding of the rotation drive D along the frame 1.

For what concerns the rotation drive D, it may consist of a rotary magnet, of a stepping motor or of a solenoid. If—as shown—the angular stroke 10 remains unvaried, the rotary magnet or stepping motor can be exactly preset for the angular stroke 10. In case the rotation drive D is operating in a single direction, spring means (not shown) can be provided to return the braking element E in the non-operating direction of the rotation drive D. Such spring means could either cooperate directly with the braking element E, or they could be mounted inside the rotation drive D to return also the drive shaft 19. Advantageously, the rotation drive D—particularly a rotary magnet M—is adapted for bi-directional operation and can be controlled in both directions. No return spring is thus required.

Thanks to the fact that the axis X of the rotation drive D is parallel to the straight yarn path C, and to the fact that the axial extensions of the stop devices 4 and 5, the clamping sleeve 20, and the fixed yarn guide elements 2, 22 and 3, all correspond to one another, it is possible to obtain a yarn brake B of compact overall dimensions. The yarn brake B can be mounted in any position, namely with the braking element E turning upwards (as shown), or else downwardly projecting from the drive shaft 19. In order to exclude as far as possible the influence of the gravity force, the braking element E should be arranged in such a way that its starting and braking positions are essentially symmetrical in respect of a vertical plane containing the drive shaft 19 and the straight yarn path C. The possibility to adjust the projecting length of the braking element E is an optional feature of the yarn brake B, which can also be omitted.

What is claimed is:

1. A yarn brake comprising:

a fixed frame;

fixed and spaced apart first and second yarn guide elements that together define a straight yarn path through the yarn brake;

a rotation drive;

at least one braking element projecting from said rotation drive beyond the straight yarn path, said at least one braking element being moved by said rotation drive in an angular stroke about a rotation axis that is spaced from and substantially parallel to the straight yarn path, the angular stroke having a starting position on one side of the straight yarn path and a braking position on an opposite side of the straight line path; and an adjustment device that varies a deviation of yarn from the straight line path when said at least one braking element is in the braking position, wherein a first distance between the rotation axis and the straight yarn path is variable.

2. The yarn brake of claim 1, wherein said adjustment device shifts the rotation axis relative to the straight line path.

3. The yarn brake of claim 1, wherein the angular stroke has a fixed amplitude regardless of the first distance.

4. The yarn brake of claim 1, further comprising a first stop device that defines the braking position.

5. The yarn brake of claim 4, further comprising a second stop device that defines the starting position.

6. The yarn brake of claim 4, wherein said first stop device comprises a resilient block in a motion path of said braking element.

7. The yarn brake of claim 4, wherein said rotation drive, said at least one braking element, and said first stop device together define one structural unit of the yarn brake, and wherein said one structural unit is movably mounted on said fixed frame so as to be movable relative to the straight yarn path.

8. The yarn brake of claim 4, wherein said first stop device is movable relative to the rotation axis.

9. The yarn brake of claim 4, wherein said rotation drive comprises a rotary magnet having a shell and a drive shaft that is substantially parallel to the straight yarn path, said at least one braking element comprises a generally U-shaped bracket with arms whose ends are fixed to said drive shaft and whose closed end extends beyond the straight yarn path, said first stop device is carried by said shell, and one of said shell and a support therefor is movably housed in a cut-out section of said fixed frame.

10. The yarn brake of claim 9, further comprising a releasable clamp on said drive shaft that holds said arms of said braking element, said releasable clamp comprising at least one clamping element for selectively adjusting a position at which said arms are held.

11. The yarn brake of claim 9, wherein an upstream one of said arms of said at least one braking element is longer than a downstream one of said arms, and wherein said closed end of said at least one braking element comprises a straight crossbar that is oblique to the straight yarn path.

12. The yarn brake of claim 9, wherein said cut-out section of said fixed frame is defined by two spaced apart sidewalls of said fixed frame that together define a sliding guide for said shell, and wherein said shell comprises an outer rectangular portion slidably fitted between said two sidewalls, and wherein at least one of said sidewalls comprises means for holding said shell.

13. The yarn brake of claim 12, wherein said means for holding said shell comprises a hole in the at least one said sidewalls and releasable fasteners engaging said hole.

14. The yarn brake of claim 12, further comprising an adjusting screw that engages said fixed frame and that moves said shell relative to said fixed frame.

15. The yarn brake of claim 9, further comprising a third yarn guide element in the straight yarn path and between said arms of said generally U-shaped bracket.

16. The yarn brake of claim 15, further comprising a generally U-shaped support attached to said fixed frame and holding a downstream one of said first and second yarn guide elements, said third yarn guide element being on a column projecting into said generally U-shaped support.

17. The yarn brake of claim 16, wherein said downstream one of said first and second yarn guide elements comprises an annular yarn eyelet, and wherein said generally U-shaped support comprises a rounded cover part that carries said annular yarn eyelet.

* * * * *

UNITED STATES PATENT AND TRADEMARK OFFICE

CERTIFICATE OF CORRECTION

PATENT NO. : 6,135,377

DATED : October 24, 2000

INVENTOR(S) : Marco COVELLI et al.

It is certified that error appears in the above-indentified patent and that said Letters Patent is hereby corrected as shown below:

In the name of the assignee, change "Nouva" to --Nuova--.

Signed and Sealed this

First Day of May, 2001

*Attest:*

Nicholas P. Godici

NICHOLAS P. GODICI

*Attesting Officer*

*Acting Director of the United States Patent and Trademark Office*